US007740244B2

(12) United States Patent
Ho

(10) Patent No.: US 7,740,244 B2
(45) Date of Patent: Jun. 22, 2010

(54) CARD CARTRIDGE FOR A SHUFFLING MACHINE

(75) Inventor: Cai-Shiang Ho, Taipei (TW)

(73) Assignee: Taiwan Fulgent Enterprise Co., Ltd., Taipei (TW)

( * ) Notice: Subject to any disclaimer, the term of this patent is extended or adjusted under 35 U.S.C. 154(b) by 230 days.

(21) Appl. No.: 12/156,962

(22) Filed: Jun. 5, 2008

(65) Prior Publication Data

US 2009/0302536 A1 Dec. 10, 2009

(51) Int. Cl.
*A63F 1/10* (2006.01)
*A63F 1/14* (2006.01)
*A63F 1/12* (2006.01)

(52) U.S. Cl. ..... 273/149 R; 273/148 A; D21/392; D21/396; D21/385; D21/333

(58) Field of Classification Search ..... 273/149 R, 273/149 P, 148 A; D21/385, 333, 392, 393, D21/396
See application file for complete search history.

(56) References Cited

U.S. PATENT DOCUMENTS 4,377,285 A * 3/1983 Kadlic ..... 273/148 A
4,750,743 A * 6/1988 Nicoletti ..... 273/148 A
5,275,411 A * 1/1994 Breeding ..... 273/149 R
5,374,061 A * 12/1994 Albrecht ..... 273/149 R
5,382,024 A * 1/1995 Blaha ..... 273/149 R
6,402,142 B1 * 6/2002 Warren et al. ..... 273/149 R
2007/0138743 A1 * 6/2007 Fleckenstein ..... 273/149 R
2007/0216092 A1 * 9/2007 Fleckenstein ..... 273/149 R

* cited by examiner

*Primary Examiner*—Benjamin H Layno
(74) *Attorney, Agent, or Firm*—William E. Pelton, Esq.; Cooper & Dunham LLP

(57) ABSTRACT

A card cartridge for shuffling machines has a body and a cover. The body has a longitudinal slot defined in the body in a slantwise manner for receiving cards discharged from the shuffling machine, and at least two stops protrude oppositely from two side edges of the body to define a drawing gap. The cover is mounted detachably on the body and has a tail extending slantwise into the slot and two side panels abutting two side surfaces of the body to ensure the cover is stably positioned on the body. Furthermore, a wedge is movably disposed in the slot, selectively moving toward the second end of the body to press the cards toward the stops. When playing a card game, the body is implemented horizontally and the wedge moves along the slot to press the cards so players can easily draw cards sequentially from the drawing gap.

3 Claims, 8 Drawing Sheets

CARD CARTRIDGE FOR A SHUFFLING MACHINE

BACKGROUND OF THE INVENTION

1. Field of the Invention

The present invention relates to a cartridge, and more particularly to a card cartridge for a shuffling machine and that has a simple structure and stores multiple cards and facilitates and accelerates card dispensation.

2. Description of Related Art

A shuffling machine is used to shuffle cards automatically and comprises a drivable shuffling storage means, an input apparatus and an output storage means. The shuffling storage means has multiple compartments to receive and hold cards and is associated with the input apparatus for inserting cards into the compartments. The output storage means is separated from the shuffling storage means and has a conveyor that has multiple active rollers arranged adjacent to each other and driven by a drive system.

Inevitably, the output storage means is complicated in structure to increase cost of fabrication, otherwise, is inadequate to store multiple cards and be placed on a table for manual dispensation. Furthermore, the conveyor must contact each card and a rate of card entrance is limited by its mechanical bottleneck, thereby limiting a card dispensing speed.

To overcome the shortcomings, the present invention provides a card cartridge for shuffling machine to obviate or mitigate the aforementioned problems.

SUMMARY OF THE INVENTION

The main objective of the present invention is to provide a card cartridge for shuffling machines with a simple structure that stores multiple cards and can be set on a table to facilitate and accelerate card dispensation.

To achieve the objective, the card cartridge in accordance with present invention is vertically mounted detachably with a shuffling machine and comprises a body and a cover.

The body has a longitudinal slot, a first end, a second end, an opening and at least two stops. The slot is defined in the body in a slantwise manner for receiving cards discharged from the shuffling machine. The opening is defined in the second end. The stops protrude oppositely from two side edges of the second end to define a drawing gap between the stops and a bottom edge of the second end.

The cover is mounted detachably on the body and has a tail extending slantwise into the slot toward the first end of the body and two side panels abutting two side surfaces of the body to ensure the cover is stably positioned on the body.

Furthermore, the card cartridge comprises a wedge movably disposed in the slot, selectively moving toward the second end of the body to press the cards toward the stops.

When playing a card game, the body is implemented horizontally on a table and the wedge moves along the slot due to gravity to press the cards so players can rapidly draw the cards sequentially out from the drawing gap.

Accordingly, the card cartridge in accordance with present invention has a simple structure and stores a mass of cards and facilitates and accelerates card dispensation.

Other objectives, advantages and novel features of the invention will become more apparent from the following detailed description when taken in conjunction with the accompanying drawings.

DETAILED DESCRIPTION OF THE PREFERRED EMBODIMENT

Figure 3:
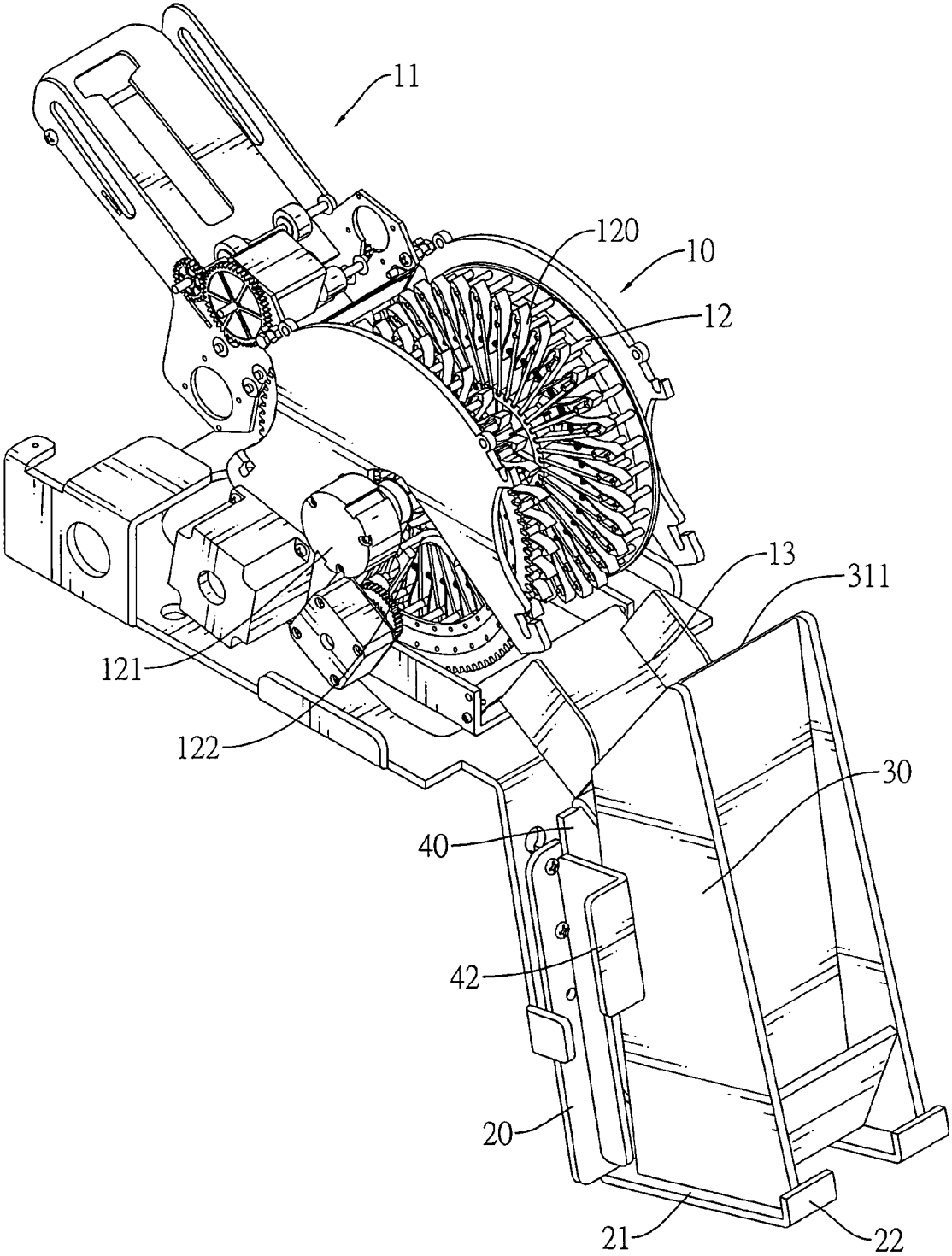
FIG. 3 is a perspective view of the card cartridge in FIG. 1, shown mounted with a shuffling machine.
Figure 4:
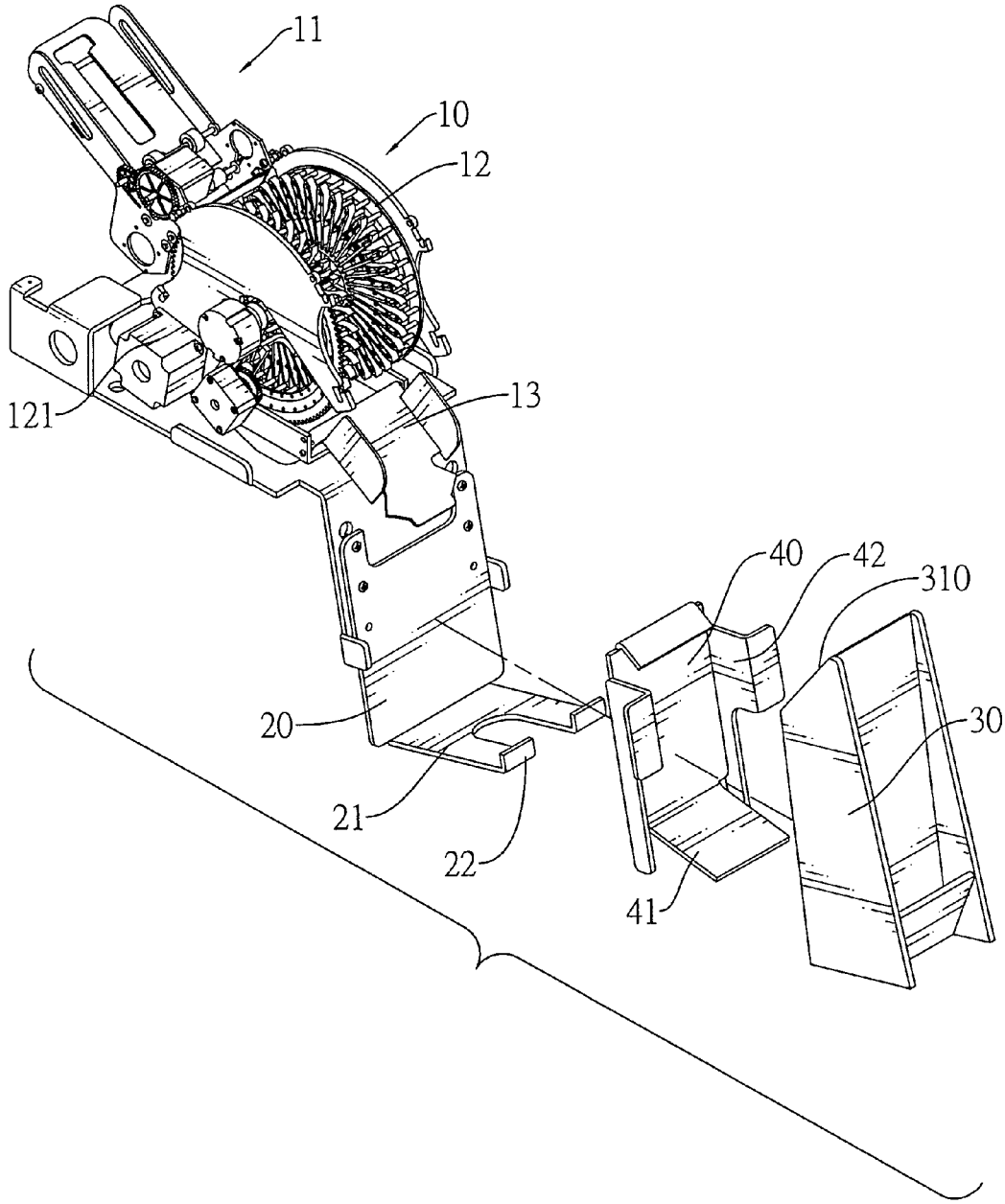
FIG. 4 is an exploded view of the card cartridge in FIG. 3.
Figure 5:
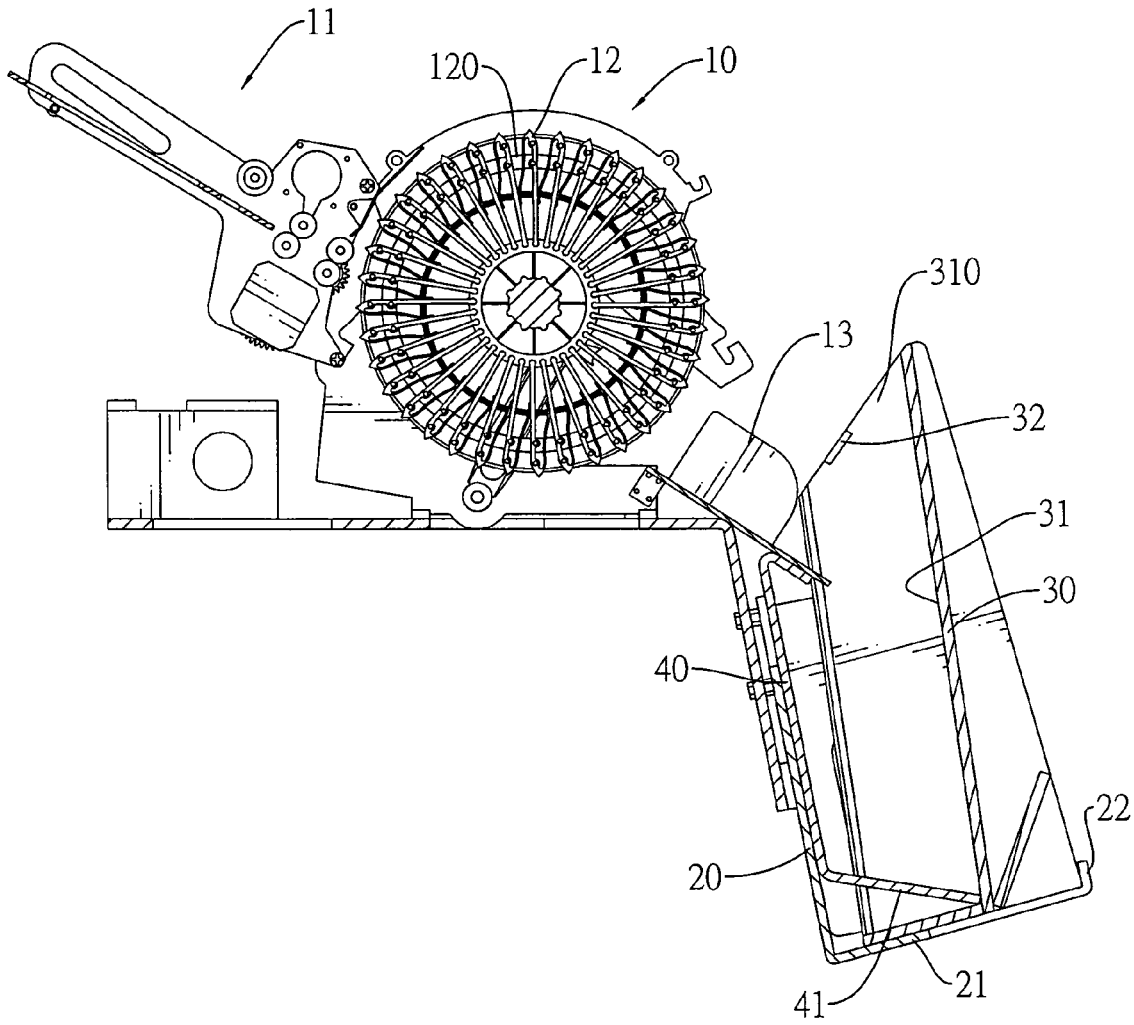
FIG. 5 is a side view in partial section of the card cartridge in FIG. 3.

With reference to FIGS. 3 to 5, a shuffling machine (10) comprises a card input (11), a shuffling wheel (12), a discharging rod (122) and a guiding element (13).

The card input (11) allows a deck of cards to placed on the shuffling machine for later randomization and has a conveyor to draw and convey the cards of deck of cards one by one along an input gap.

The shuffling wheel (12) is mounted rotatably on a base and has multiple card slots, is controlled by a controller (121) to randomly align one of the multiple card slots (120) with the input gap to receive and store at least one card conveyed by the conveyor.

The discharging rod (122) is mounted pivotally on the base, is mounted adjacent to the shuffling wheel (12) and can be driven to pivot by a rod driver. The discharging rod (122) selectively aligns with one of the card slots (120) to eject the card out of the card slot (120).

The guiding element (13) is mounted securely on the base adjacent to the shuffling wheel (12) and defines a slanted slope allowing the cards discharged to slide along which.

Figure 1:
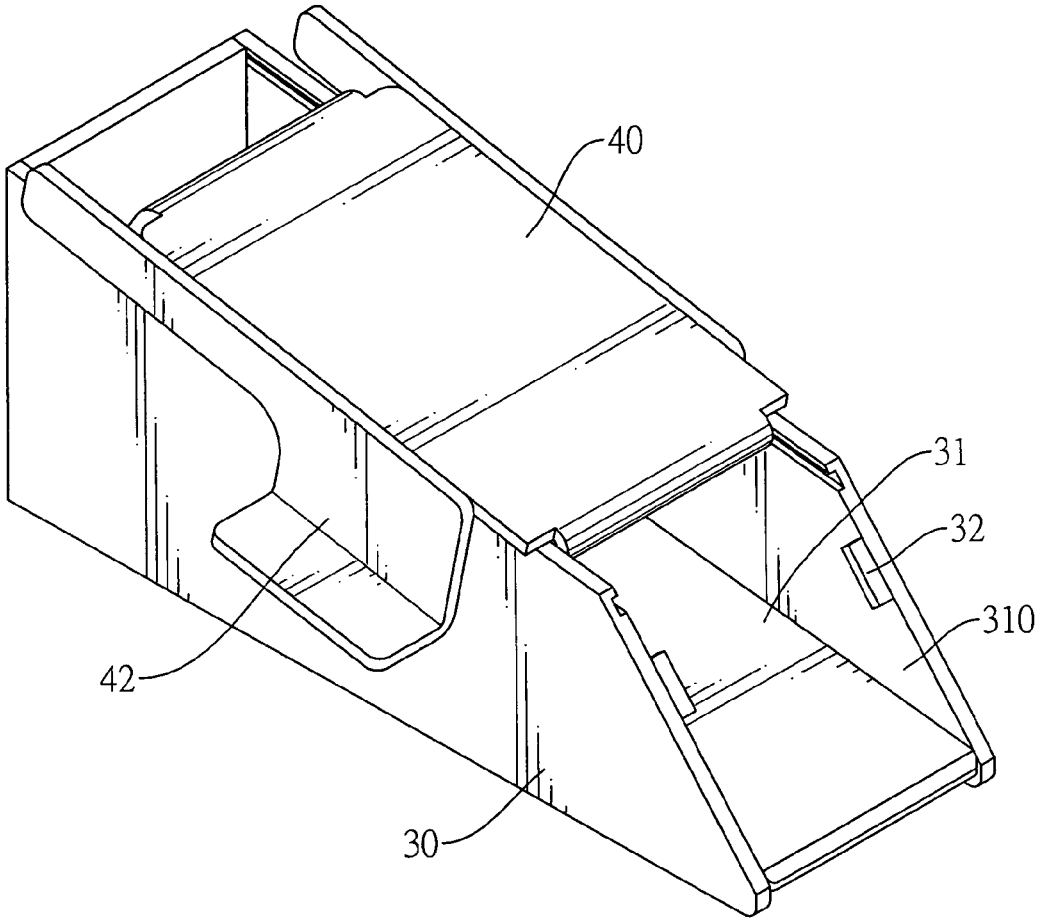
FIG. 1 is a perspective view of a card cartridge for shuffling machines in accordance with the present invention.
Figure 2:
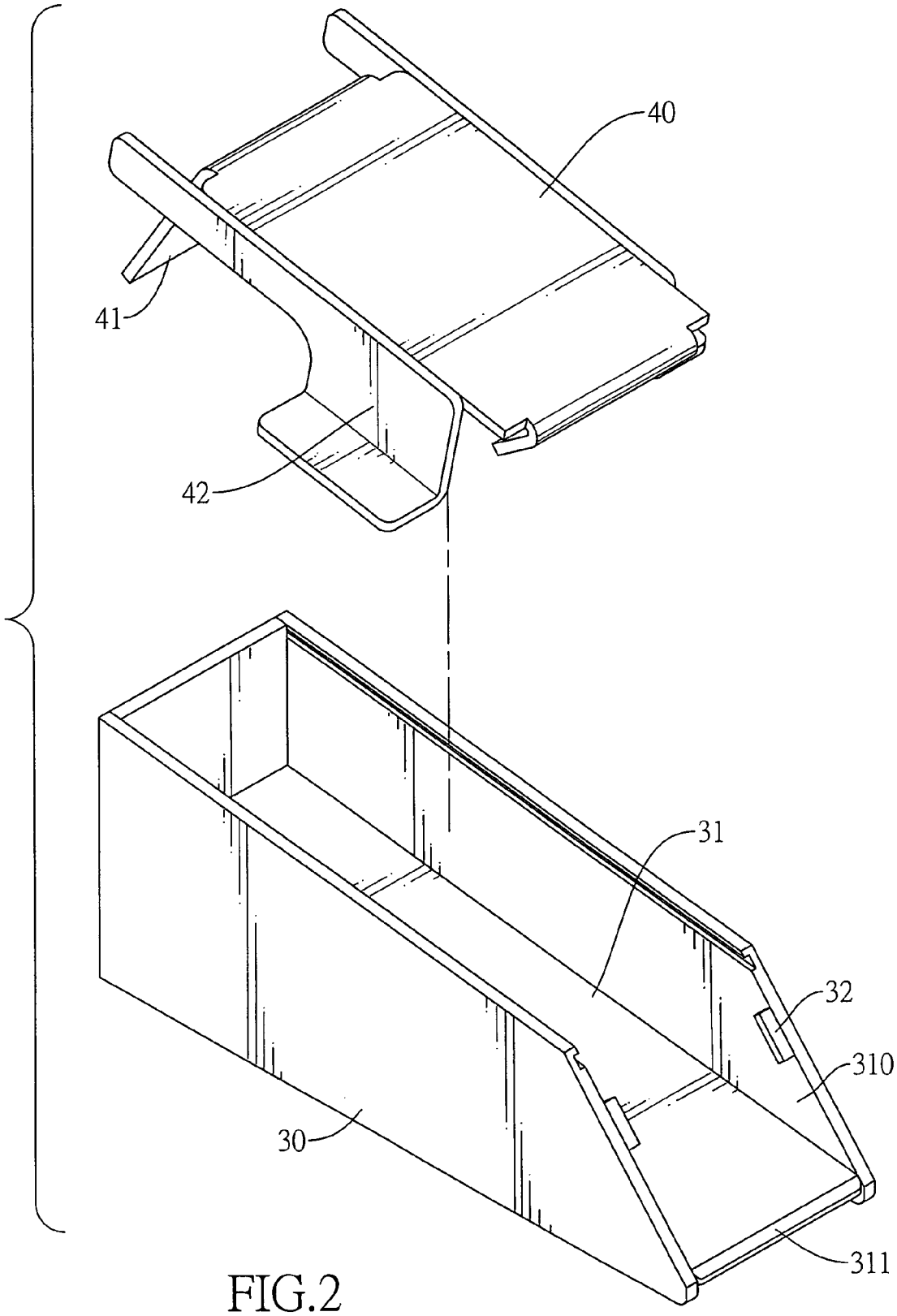
FIG. 2 is an exploded view of the card cartridge in FIG. 1.
Figure 8:
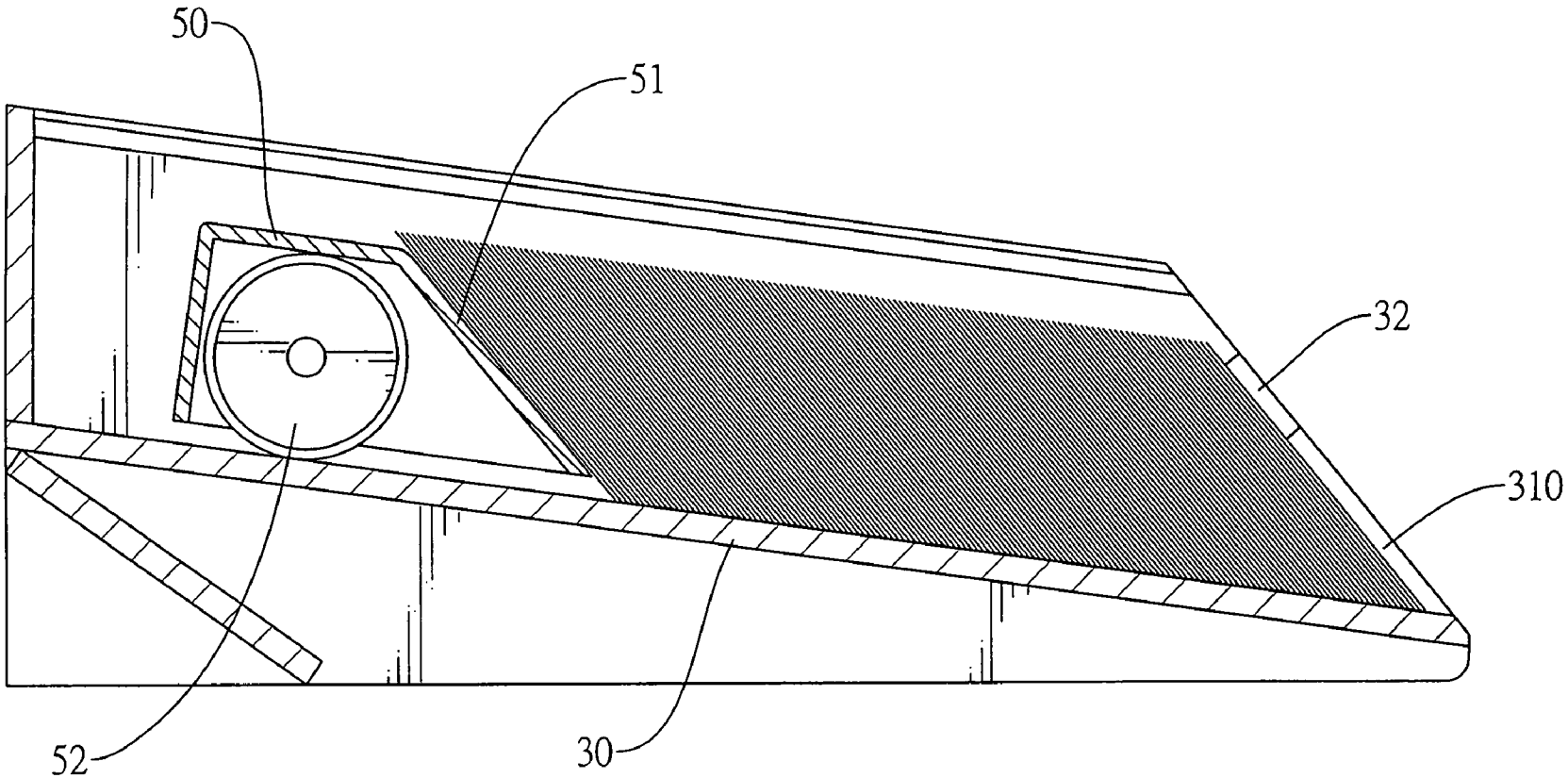
FIG. 8 is another operational side view in partial section of the card cartridge for shuffling machine in FIG. 1, shown with a wedge to aid card dispensing.

With further reference to FIGS. 1, 2 and 8, the card cartridge in accordance with the present invention comprises a bracket (20), a body (30), a cover (40) and a wedge (50).

The bracket (20) is L-shaped and has a top end, a bottom end and a holding portion (21). The top end is mounted securely on the base of the shuffling machine (10). The holding portion (21) has a distal end and protrudes transversely from the bottom end of the bracket (20) and has a retaining portion (22) protruding from the distal end.

The body (30) has two side surfaces, a slot (31), a first end, a second end, an opening (310) and at least two stops (32). The slot (31) is longitudinally defined in the body (30) in a slantwise manner. The second end has two slanted side edges and a guiding edge (311). The opening (310) is defined in the second end between the side edges and the guiding edge. The stops (32) protrude oppositely from the side edges of the second end of the body (30) and define a drawing gap between the stops (32) and the guiding edge of the second end of the body (30).

The cover (40) is mounted detachably on the body (30) and has a tail (41) and two side panels (42). The tail (41) extends slantwise into the slot (31) toward the first end of the body (30). The side panels (42) abut the side surfaces of the body (30) to ensure the cover (40) is stably positioned on the body (30).

The wedge (50) is disposed in the slot (31) and has a bottom, two sides, a pressing surface (51) and a roller (52). The pressing surface (51) is corresponds to the second end of the body (30). The roller (52) is rotatably mounted in the bottom of the wedge (50) and allows the wedge (50) to move smoothly along the slot (31) toward the second end of the body (30).

Figure 6:
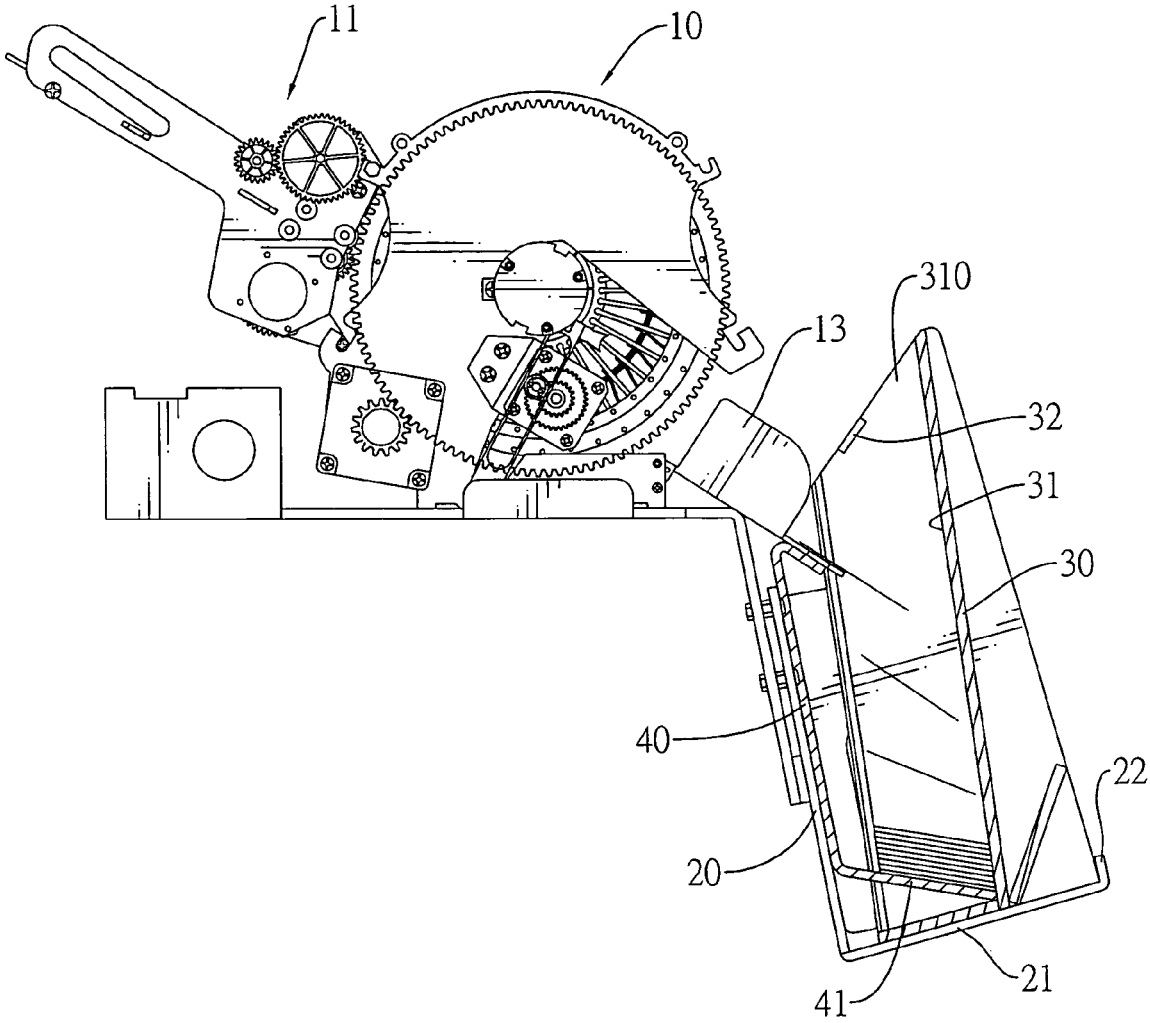
FIG. 6 is an operational side view in partial section of the card cartridge in FIG. 3.

With further reference to FIG. 6, when collecting the cards, the body (30) covered by the cover (40) is mounted vertically on the holding portion (21) of the bracket (20) and secured by the retaining portion (22) of the holding portion (21), and the slot (31) of the body (30) communicates with the slope of the guiding element (13) via the opening (310). Therefore discharged cards may slide along the slope of the guiding element (13) and drop into the slot (31) and stack on the tail (41) of the cover (40).

Figure 7:
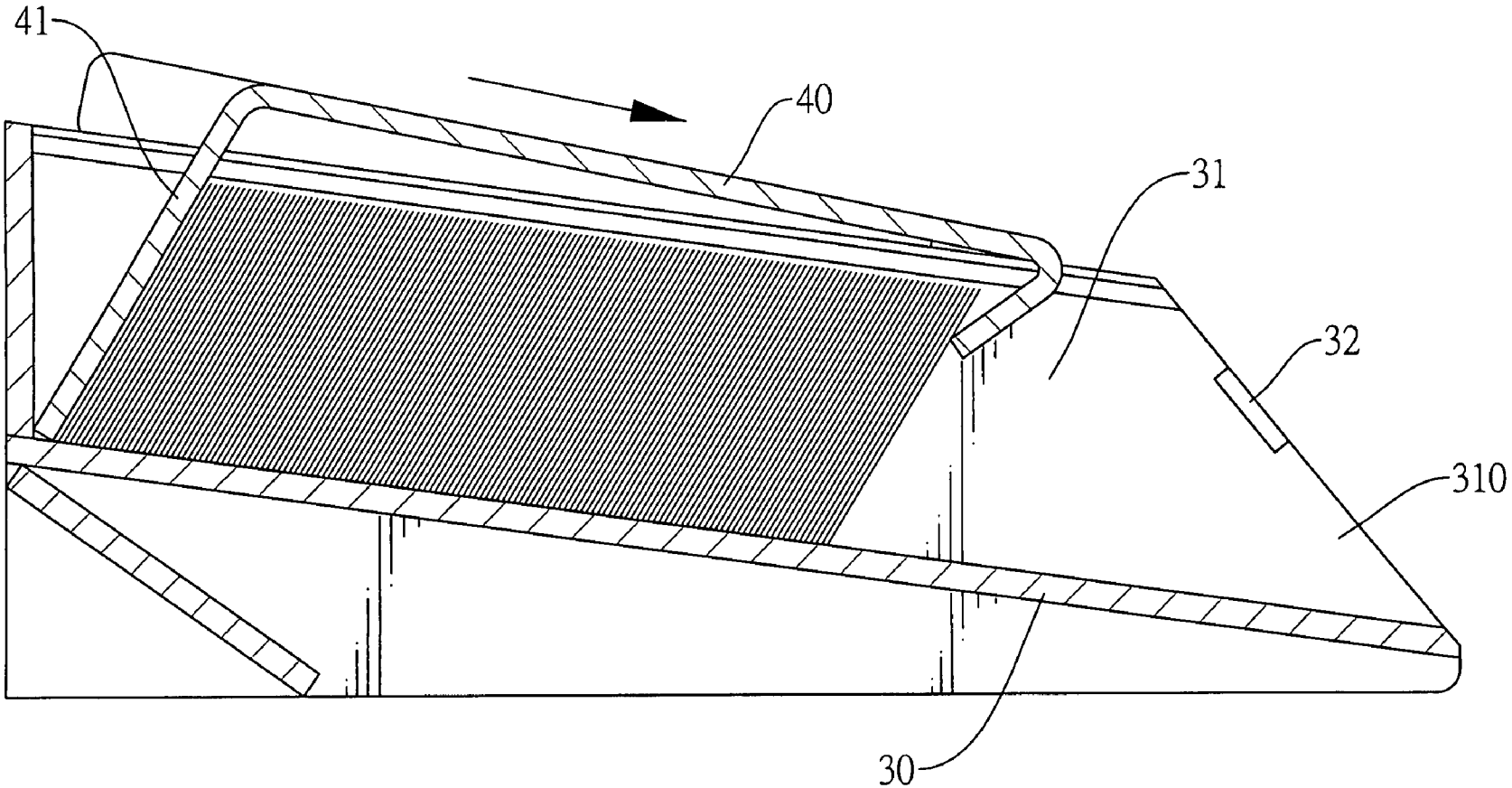
FIG. 7 is an enlarged operational side view in partial section of the card cartridge for shuffling machines in FIG. 1.

With further reference to FIG. 7, when playing a card game, the body (30) is disposed horizontally on a table, the cards are pulled forward by the tail (41) of the cover (40), then the wedge (50) is mounted in the slot (31) to press the cards. The wedge (50) moves along the slot (31) due to gravity and the pressing surface (51) presses the cards against the stops (32) to ensure that one of the cards is adjacent to the stops (32). Therefore, cards can be easily and quickly drawn from the drawing gap.

Accordingly, the card cartridge in accordance with present invention has a simple structure and stores a mass of cards and facilitates and accelerates card dispensation.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A card cartridge for a shuffling machine comprising a body having two side surfaces;

a slot being longitudinally defined in the body in a slantwise manner;

a first end;

a second end having two slanted side edges and a guiding edge;

an opening being defined in the second end between the side edges and the guiding edge; and at least two stops protruding oppositely from the side edges of the second end of the body and defining a drawing gap between the stops and the guiding edge of the second end of the body; and a cover being mounted detachably on the body and having a tail extending slantwise into the slot toward the first end of the body; and two side panels abutting two side surfaces of the body to ensure the cover is stably positioned on the body.

2. The card cartridge as claimed in claim 1 further has a bracket being L-shaped and having a top end being adapted to be mounted securely on the shuffling machine;

a bottom end; and a holding portion having a second end and protruding transversely from the bottom end of the bracket and having a retaining portion protruding from the second end.

3. The card cartridge as claimed in claim 1 further has a wedge being disposed in the slot and having a bottom;

a pressing surface corresponding to the second end of the body; and a roller being rotatably mounted in the bottom of the wedge and allowing the wedge to selectively move smoothly along the slot toward the second end of the body.

* * * * *

US007740244C1

(12) EX PARTE REEXAMINATION CERTIFICATE (9589th)

United States Patent

Ho

(10) Number: US 7,740,244 C1

(45) Certificate Issued: Apr. 10, 2013

(54) CARD CARTRIDGE FOR A SHUFFLING MACHINE

(75) Inventor: Cai-Shiang Ho, Taipei (TW)

(73) Assignee: Taiwan Fulgent Enterprise Co., Ltd., Taipei (TW)

Reexamination Request:
No. 90/012,594, Sep. 14, 2012

Reexamination Certificate for:

| | |
|---|---|
| Patent No.: | **7,740,244** |
| Issued: | **Jun. 22, 2010** |
| Appl. No.: | **12/156,962** |
| Filed: | **Jun. 5, 2008** |

(51) Int. Cl.

| | |
|---|---|
| ***A63F 1/10*** | (2006.01) |
| ***A63F 1/14*** | (2006.01) |
| ***A63F 1/12*** | (2006.01) |

(52) U.S. Cl.
USPC ..... 273/149 R; 273/148 A; D21/392; D21/396; D21/385; D21/333

(58) Field of Classification Search ..... None
See application file for complete search history.

(56) References Cited

To view the complete listing of prior art documents cited during the proceeding for Reexamination Control Number 90/012,594, please refer to the USPTO's public Patent Application Information Retrieval (PAIR) system under the Display References tab.

*Primary Examiner* — Danton DeMille

(57) ABSTRACT

A card cartridge for shuffling machines has a body and a cover. The body has a longitudinal slot defined in the body in a slantwise manner for receiving cards discharged from the shuffling machine, and at least two stops protrude oppositely from two side edges of the body to define a drawing gap. The cover is mounted detachably on the body and has a tail extending slantwise into the slot and two side panels abutting two side surfaces of the body to ensure the cover is stably positioned on the body. Furthermore, a wedge is movably disposed in the slot, selectively moving toward the second end of the body to press the cards toward the stops. When playing a card game, the body is implemented horizontally and the wedge moves along the slot to press the cards so players can easily draw cards sequentially from the drawing gap.

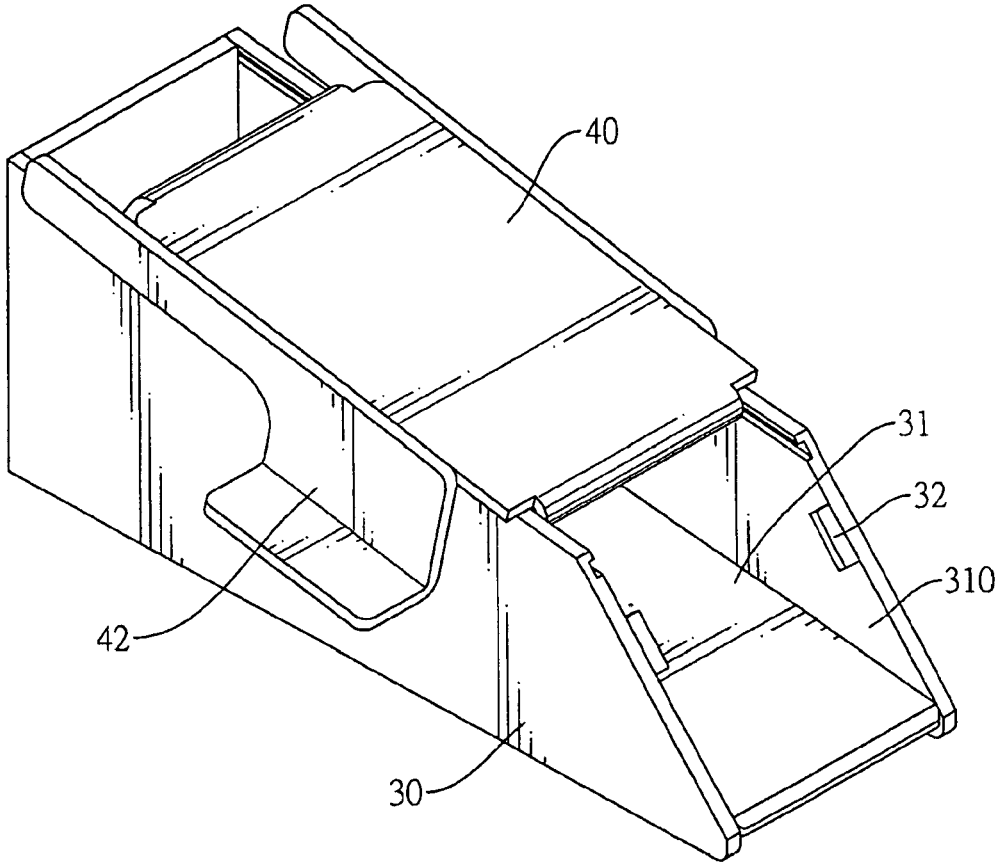

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1-3 is confirmed.

* * * * *